US009551150B2

(12) United States Patent
Wood

(10) Patent No.: US 9,551,150 B2
(45) Date of Patent: Jan. 24, 2017

(54) TENSIONABLE THREADED REBAR BOLT

(71) Applicant: NUCOR CORPORATION, Charlotte, NC (US)

(72) Inventor: Charles D. Wood, Birmingham, AL (US)

(73) Assignee: NUCOR CORPORATION, Charlotte, NC (US)

( * ) Notice: Subject to any disclaimer, the term of this patent is extended or adjusted under 35 U.S.C. 154(b) by 0 days.

(21) Appl. No.: 14/852,048

(22) Filed: Sep. 11, 2015

(65) Prior Publication Data

US 2015/0376902 A1 Dec. 31, 2015

Related U.S. Application Data

(63) Continuation of application No. 13/805,277, filed as application No. PCT/US2011/041582 on Jun. 23, 2011, now abandoned.

(Continued)

(51) Int. Cl.
*F16B 39/02* (2006.01)
*E04C 5/02* (2006.01)

(Continued)

(52) U.S. Cl.
CPC ..... *E04C 5/02* (2013.01); *E21D 20/025* (2013.01); *E21D 21/004* (2013.01); *E21D 21/008* (2013.01)

(58) Field of Classification Search
CPC ..... E04C 5/02; E21D 20/025; E21D 21/004; E21D 21/008; F16B 39/02

(Continued)

(56) References Cited

U.S. PATENT DOCUMENTS 1,977,285 A 10/1934 McCleery
2,377,980 A 6/1945 Surerus (Continued)

FOREIGN PATENT DOCUMENTS

CH 291440 6/1953
CN 2547875 Y 4/2004

(Continued)

OTHER PUBLICATIONS

Necheporenko V. A. et al., "Pressure Treatment of Metals—Production of Reinforcing-Bar Steel by Two-Strand Rolling and Separating"; Steel in Translation, Allerton Press, New York, NY; vol. 29, No. 6, pp. 32-34, Jan. 1, 1999, XP000976468, ISSN: 0967-0912.

(Continued)

*Primary Examiner* — Roberta Delisle
(74) *Attorney, Agent, or Firm* — Moore & Van Allen PLLC; Jeffrey R. Gray

(57) ABSTRACT

Embodiments of the present invention include hot-rolled threaded rebar bolts that have a substantially circular core with semi-continuous threads on opposing sides of the rebar bolts. In some embodiments of the invention the shaft is substantially void of longitudinal ribs along at least a portion of the longitudinal area between the first set of threads and the second set of threads of the shaft. The threaded rebar bolt is manufactured in a continuous hot-rolling process to create a threaded rebar shaft with semi-continuous threads and substantially no longitudinal ribs in the longitudinal areas and no additional machining is required to create the threads after the threaded shaft is created from the hot-rolling process.

20 Claims, 3 Drawing Sheets

Related U.S. Application Data

(60) Provisional application No. 61/358,355, filed on Jun. 24, 2010.

(51) Int. Cl.
*E21D 21/00* (2006.01)
*E21D 20/02* (2006.01)

(58) Field of Classification Search
USPC ..... 411/82, 417, 418
See application file for complete search history.

(56) References Cited

U.S. PATENT DOCUMENTS 2,821,727 A 2/1958 Corckran
3,214,877 A 11/1965 Akin
3,222,873 A 12/1965 Williams
3,256,727 A 6/1966 Takaishi
3,494,164 A 2/1970 Rehm et al.
3,561,185 A * 2/1971 Finsterwalder et al. .. E04C 5/03 52/853
3,928,998 A 12/1975 Torres
4,023,784 A 5/1977 Wallace
4,033,502 A 7/1977 Rothchild
4,056,911 A 11/1977 Tani
4,076,163 A 2/1978 Grande
4,087,898 A 5/1978 Linne
4,092,814 A 6/1978 Kern
4,114,344 A 9/1978 Heasman
4,137,686 A * 2/1979 Kern ..... E04C 5/03 52/851
4,143,986 A 3/1979 Antosh
4,159,633 A 7/1979 Linne
4,193,283 A 3/1980 Bowman et al.
4,193,686 A 3/1980 Klank
4,229,501 A * 10/1980 Kern ..... E04C 5/03 428/399
4,241,490 A 12/1980 Edwards
4,295,761 A 10/1981 Hansen
4,307,979 A 12/1981 Killmeyer
4,313,697 A 2/1982 Rozanc
4,357,819 A 11/1982 Elley
4,386,877 A 6/1983 McDowell, Jr.
4,402,633 A 9/1983 Self
4,472,088 A 9/1984 Martin
4,477,209 A 10/1984 Hipkins, Jr. et al.
4,501,515 A 2/1985 Scott
4,516,886 A 5/1985 Wright
4,518,292 A 5/1985 Calandra, Jr.
4,531,861 A 7/1985 Kash
4,564,315 A 1/1986 Rozanc
4,584,247 A * 4/1986 Mulholland ..... E04C 5/08 411/411
4,595,315 A 6/1986 Gallagher, Jr.
4,605,449 A 8/1986 Schummer et al.
4,607,984 A 8/1986 Cassidy
4,618,291 A 10/1986 Wright
4,619,096 A 10/1986 Lancelot, III
4,627,212 A 12/1986 Yee
4,630,971 A 12/1986 Herbst et al.
4,649,729 A 3/1987 McDowell et al.
4,655,645 A 4/1987 Hipkins, Sr. et al.
4,659,258 A 4/1987 Scott
4,664,555 A 5/1987 Herbst
4,664,561 A 5/1987 Frease
4,666,326 A 5/1987 Hope
4,678,374 A 7/1987 Calandra, Jr.
4,679,966 A 7/1987 Yacisin
4,708,559 A 11/1987 Locotos
4,750,887 A 6/1988 Simmons
4,752,159 A 6/1988 Howlett
4,764,055 A 8/1988 Clark et al.
4,779,439 A 10/1988 Baldi
4,811,541 A 3/1989 Finsterwalder
4,856,952 A * 8/1989 Shaw ..... E04C 5/03 411/413
4,858,457 A 8/1989 Potucek
4,861,197 A 8/1989 Calandra, Jr.
4,870,848 A 10/1989 Kies et al.
4,922,681 A 5/1990 Russwurm et al.
4,946,314 A 8/1990 Gruber
4,953,379 A * 9/1990 Richartz ..... B21B 1/163 72/187
4,955,758 A 9/1990 Hyde
5,013,192 A 5/1991 Scott
5,044,832 A 9/1991 Gruber
5,046,878 A 9/1991 Young
5,067,844 A 11/1991 Bowmer et al.
5,073,065 A 12/1991 Kleineke
5,094,577 A 3/1992 Clark et al.
5,114,278 A 5/1992 Locotos et al.
5,127,769 A 7/1992 Tadolini et al.
5,152,118 A 10/1992 Lancelot
5,158,527 A 10/1992 Bernard
5,222,835 A 6/1993 Wright
5,234,291 A 8/1993 Swemmer
5,282,698 A 2/1994 Wright et al.
5,352,065 A 10/1994 Arnall et al.
5,375,946 A 12/1994 Locotos
5,383,740 A 1/1995 Lancelot, III
5,387,060 A 2/1995 Locotos
5,411,347 A 5/1995 Bowmer et al.
5,433,558 A 7/1995 Gray
5,443,331 A 8/1995 Seegmiller
5,468,524 A 11/1995 Albrigo et al.
5,490,365 A 2/1996 Roth
5,544,980 A 8/1996 Seegmiller
5,556,234 A 9/1996 Oldsen et al.
5,570,976 A 11/1996 Fuller et al.
5,611,190 A 3/1997 Van Merksteijn
5,626,044 A 5/1997 Lara-Castro
5,664,902 A 9/1997 Holdsworth
5,669,196 A 9/1997 Dahl
5,735,653 A 4/1998 Schiefer et al.
5,743,978 A 4/1998 Otto et al.
5,763,042 A 6/1998 Kaiser et al.
5,775,850 A * 7/1998 Gale ..... E21D 21/0026 405/259.1
5,791,823 A 8/1998 Blakley et al.
5,791,824 A 8/1998 Radtke
5,851,468 A 12/1998 Kaiser
5,876,553 A 3/1999 Kaiser
5,882,148 A 3/1999 Mraz
6,039,509 A 3/2000 Locotos
6,298,705 B1 10/2001 Shore
6,390,735 B1 5/2002 Gaudreau et al.
6,428,243 B1 8/2002 Hutchins
6,474,910 B2 11/2002 Lay
6,484,471 B2 11/2002 Steed et al.
6,491,478 B2 12/2002 Sager et al.
6,568,056 B2 5/2003 Sclippa
6,676,352 B2 * 1/2004 Chen-Chi ..... F16B 37/127 411/178
6,698,980 B2 3/2004 Mongrain
6,886,384 B2 * 5/2005 Gray ..... E04C 5/163 405/259.1
6,994,496 B2 2/2006 Mills
7,044,688 B2 5/2006 Dever et al.
7,147,404 B2 12/2006 Spearing et al.
7,296,950 B1 11/2007 Stankus et al.
7,338,234 B2 3/2008 Rataj et al.
7,481,603 B1 1/2009 Fox
7,566,189 B2 7/2009 Simmons et al.
7,624,556 B2 * 12/2009 Plooksawasdi ..... E04C 5/03 52/849
7,736,738 B2 6/2010 Simmons et al.
7,775,745 B2 8/2010 Simmons et al.
2003/0012596 A1 * 1/2003 Copping ..... E04C 5/165 403/313
2004/0161305 A1 8/2004 Simmons et al.
2004/0161316 A1 8/2004 Locotos et al.
2007/0036617 A1 2/2007 Oldsen et al.
2007/0269274 A1 11/2007 Seedsman

(56) References Cited

U.S. PATENT DOCUMENTS

| | | | |
|---|---|---|---|
| 2008/0219775 | A1 | 9/2008 | Mercier-Langevin et al. |
| 2009/0052995 | A1 | 2/2009 | Eriksson et al. |
| 2009/0074516 | A1 | 3/2009 | Craig |
| 2009/0136302 | A1 | 5/2009 | Fox |
| 2010/0003088 | A1 | 1/2010 | Grocholewski et al. |
| 2010/0015461 | A1 | 1/2010 | Larsen et al. |
| 2010/0074696 | A1 | 3/2010 | Williams |
| 2010/0252953 | A1 | 10/2010 | Simmons et al. |

FOREIGN PATENT DOCUMENTS

| | | | |
|---|---|---|---|
| DE | 3108268 | A1 | 9/1982 |
| DE | 10008693 | A1 | 9/2001 |
| JP | 54124861 | A1 | 9/1979 |
| JP | 63-286233 | | 11/1988 |
| WO | 03/102374 | A1 | 12/2003 |
| WO | 2005/021182 | A1 | 3/2005 |

OTHER PUBLICATIONS

PCT International Search Report for International Application No. PCT/US11/41582 mailed Nov. 23, 2011.

Second Written Opinion of the International Preliminary Examination Authority for International Application No. PCT/JS2011/061244 mailed Jan. 17, 2013.

PCT International Search Report for International Application No. PCT/US2011/061244 dated Mar. 22, 2012.

European Examination Report dated Feb. 27, 2015 for European Patent Application No. 11788751.3.

* cited by examiner

TENSIONABLE THREADED REBAR BOLT

CLAIM OF PRIORITY UNDER 35 U.S.C. §120

This application is a continuation of, and claims priority to, co-pending U.S. patent application Ser. No. 13/805,277, filed on Apr. 25, 2013 and entitled "Tensionable Threaded Rebar Bolt," which is a national stage application of, and claimed priority to, PCT/US2011/041582, filed on Jun. 23, 2011 and entitled "A Tensionable Threaded Rebar Bolt," which claimed priority to U.S. Provisional Patent Application Ser. No. 61/358,355, filed on Jun. 24, 2010 and entitled "System and Method of Making a Spiral Bolt Bar, and Methods of Use", which are all assigned to the assignee hereof and hereby expressly incorporated by reference herein.

FIELD

This invention relates to the field of fasteners, and more particularly to hot-rolled threaded rebar bolts for use in various applications, such as but not limited to mine roof bolting technology for use with resin nuts, concrete support structure applications, or other similar support structure mediums.

BACKGROUND OF THE INVENTION

U.S. Pat. Nos. 7,481,603 and 7,758,284 granted to William G. Fox (hereinafter the "Fox patents") discloses a tensionable bolt (i.e. spiral and threaded) for use with resin nuts, and related methods, for installation in a borehole in a mine in order to support the mine from collapsing. The disclosure in the Fox patents is designed to provide support in passages of geological structures, such as mines, in an efficient, secure, and cheap way. The apparatus disclosed in the Fox patents provides a structure supporting means that is easy to use and install, does not result in protrusions from the mine support structure, has excellent tensioning/holding characteristics, has minimal tension bleed-off, and has the capability of being re-tensioned by rotation of the spiral bolt after columnar grouting. U.S. Pat. Nos. 7,481,603 and 7,758,284 are hereby incorporated by reference for all purposes.

Throughout the initial investigation of the invention disclosed in the Fox patents, manufacturing companies have found that there is not a practical method of producing the desired large quantities of bolts for the system because the bolts had to be made from standard merchant round steel bar run through cut-threading or roll-threading machines (e.g., a Landis threading machine), which produce one thread at a time by rotating the head around a stationary round bar and continuing along the shaft a defined length, usually at least 24 inches. The use of such cold-cutting and/or cold-forming processes is very slow and costly, and as such the manufacturing quantity is restricted and incapable of meeting product demand for the mining bolts at a low cost.

Bolts and screws are typically manufactured through the use of a threading process, such as machined threads, cast threads, or cold-rolled threads. In the machining process, threads are cut in a milling process on conventional or computer numerical control ("CNC") machines. In the casting process the threads are formed by the internal surface of the casting mold. In the cold-rolling process the threads are created by rolling bar stock to form threads of the fastener through sets of two or more dies in a perpendicular orientation to the movement of one or more of the movable dies in a die set. These manufacturing processes can be costly because of the set-up and manufacturing times associated with creating specialized fasteners for various applications.

In some applications, such as the case with utilizing bolts in a mine shaft roof application, or other structural support applications, three-hundred thousand (300,000) to five-hundred thousand (500,000) bolts per month, or other amounts besides this range, may need to be manufactured to supply a single mine. This may translate into around three hundred fifty (350) plus tons of bolt stock for structural support applications in a single mine.

Different types of bolting systems and associated manufacturing processes have been implemented to either utilize standardized bolts or manufacture specialized bolts in cheaper processes that can be used in support structures. However, each invention has its own associated problems. A summary of some prior art bolts systems and processing methods are described briefly below.

U.S. Pat. No. 4,861,197 illustrates a mechanical anchor including an expansion shell and an expansion plug positioned in the shell and engaged with the end of a bar having helically extending rib segments formed on the outer surface of the bar. This bolt system is designed to employ an expansion shell as the anchoring mechanism.

U.S. Pat. No. 4,953,379 describes a method of hot-rolling full continuous threads around a bar for use in concrete reinforcing. This method is, however complicated by the mandatory employment of two sets of individually synchronized tandem mill rolls rotated at ninety (90) degrees from each other and then synchronized with each other to roll top and bottom threads, and the two side threads, thereby forming a continuous thread for the application of an anchoring or connecting member with a female thread.

U.S. Pat. No. 4,922,681 illustrates a bolt that is specifically designed to not rotate. It comprises a circular core cross-section and two rows lying opposite each other which are arranged along a helical line and form portions of a thread for screwing on an anchoring or connecting body provided with counter thread. The steps serve to improve the bond of the concrete reinforcing bar to the concrete.

U.S. Pat. No. 5,775,850 depicts particular thread forms to provide a rock bolt for use in a rock bolt system which enables the rock bolt system to have an improved performance when compared with rock bolt systems based on known rock bolts.

U.S. Pat. No. 6,886,384 B2 describes a thread form on opposing sides of a smooth bar but with the threads offset by an amount of half the thread pitch. The ribs which are so formed protrude from the bar and typically form a discontinuous thread around and along the bar. This thread form allows for the application of couplers but prohibits rotation in a set grouting medium.

There is a need for cost-effective and efficient specialized bolts that can be used in support structure applications, such as mining, tunneling, earth stabilization or construction, which can replace bolts manufactured through standard processes, but still have the same or better structural capabilities.

BRIEF SUMMARY OF THE INVENTION

Embodiments of the present invention address the above needs and/or achieve other advantages by providing hot-rolled threaded rebar bolts that are cheaper to manufacture but maintain the same or similar structural benefits of more costly manufactured bolts and that can be produced in high volumes.

One embodiment of the invention is directed generally to bolts for use in mine roof support applications, or other structural support applications, that are manufactured by hot-rolling a steel bar (i.e. rebar) into a threaded bolt. This methodology would also have the secondary benefit of eliminating the material waste of standard thread-cutting schemes. In many embodiments, the process efficiently makes large quantities of specialty semi-continuously threaded bolts adapted for use with a columnar resin nut disposed in bore holes in geological structures.

The features, functions, and advantages that have been discussed may be achieved independently in various embodiments of the present invention or may be combined in yet other embodiments, further details of which can be seen with reference to the following description and drawings.

BRIEF DESCRIPTION OF THE SEVERAL VIEWS OF THE DRAWINGS

Figure 1:
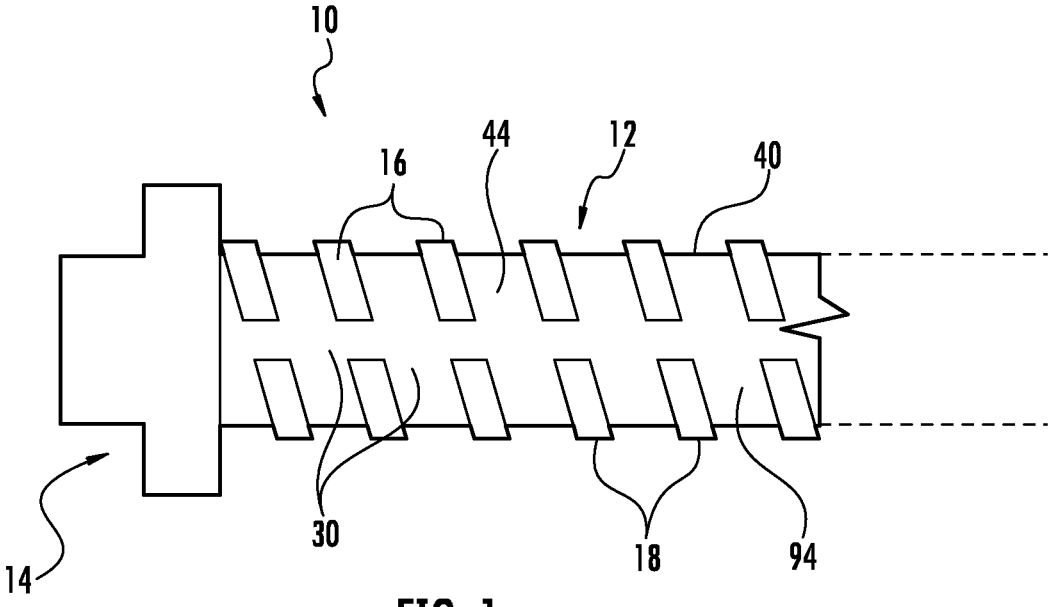
Figure 2:
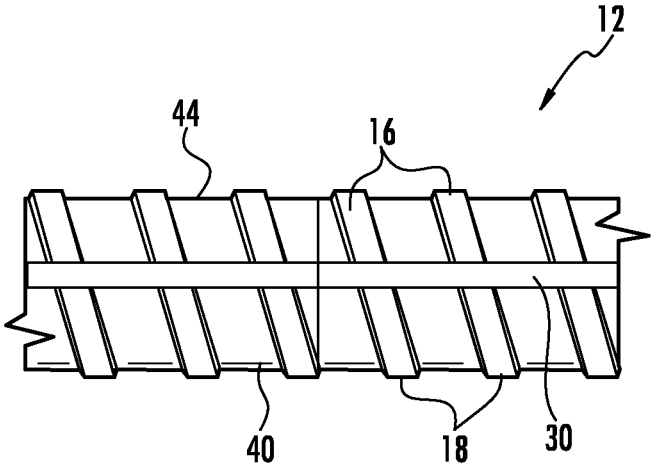
Figure 3:
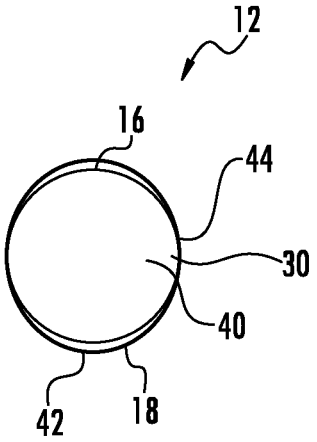
Figure 4:
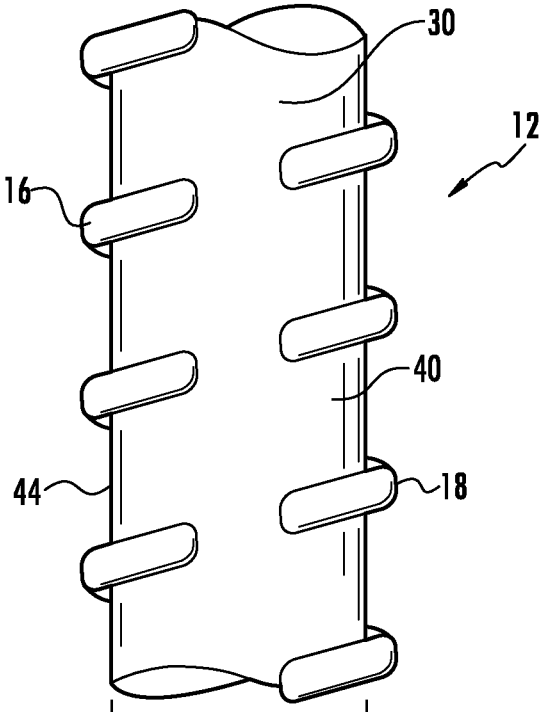
Figure 5:
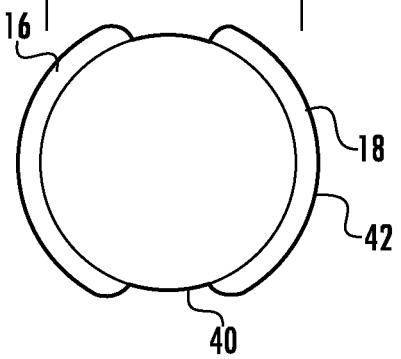

Having thus described embodiments of the invention in general terms, reference will now be made to the accompanying drawings, which are not necessarily drawn to scale, and wherein:

FIG. 1 provides a side view of a threaded rebar bolt, in accordance with one embodiment of the invention;

FIG. 2 provides a side view of the shaft of a threaded rebar bolt, in accordance with one embodiment of the invention;

FIG. 3 provides an end view of the shaft of a threaded rebar bolt, in accordance with one embodiment of the invention;

FIG. 4 provides a side view of the shaft of a threaded rebar bolt, in accordance with one embodiment of the invention; and FIG. 5 provides an end view of the shaft of a threaded rebar bolt, in accordance with one embodiment of the invention.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates a threaded rebar bolt 10 in accordance with one embodiment of the present invention. As illustrated in FIG. 1, the threaded rebar bolt 10 comprises a shaft 12 and a bolt head 14. The shaft 12 comprises a core 40, a first set of threads 16, and a second set of threads 18. The first set of threads 16 and the second set of threads 18 are aligned to form a semi-continuous thread around the shaft 12 of the threaded bolt 10, such that the threaded bolt can be secured in a corresponding coupling (i.e. nut, resin nut, concrete, etc.). In some embodiments of the invention the shaft 12 is substantially void of longitudinal ribs along at least a portion of the longitudinal area 30 between the first set of threads 16 and the second set of threads 18 of the shaft 12. In some embodiments of the invention the shaft 12 is substantially void of longitudinal ribs along the entire length of the longitudinal area 30 of the shaft 12. In these embodiments the longitudinal area 30 may have a height that is substantially the same as the core surface 44. In other embodiments of the invention the shaft 12 is completely void of longitudinal ribs along a portion of or the entire longitudinal area 30. Thus, the longitudinal ribs have a height that does not rise above the core surface 44, hence the longitudinal areas 30 are at least flush with the core surface 44 of the core 40 of the shaft 12. In other embodiments of the invention the longitudinal areas 30 may be below the height of the core surface 44. For example, the longitudinal areas 30 may have a concave surface, a rectangular surface, etc. that is sunk below the core surface 44.

In some embodiments of the invention, for example, in the mining roof support applications, specialized bolts may be required to have an average bolt length of approximately forty-eight (48) inches, a preferred three-fourths (¾) inch bolt diameter, and twenty-four (24) inches of thread. These dimensions are provided merely as an example, and it is to be understood that in other embodiments of the invention the dimensional requirements of the bolt may be less or greater than the dimensions provided herein. However, in the mining roof support applications twenty-four (24) inches of thread may be the minimum acceptable thread length for use with a resin nut.

There are a number of issues associated with bolts that are currently available for use in mine roof support structures and other structural support applications, such as but not limited to, the costs of manufacturing the support system, assembling the system, lack of ability to tension the bolts at any time, etc. The difficulty in manufacturing relates to producing bolts of the size necessary for use in structural supports in large quantities through milling operations or perpendicular rolling operations.

Hot-rolling steel into rebar may be known in the art, but the rebar that is currently produced through a hot-rolling process is not satisfactory for use in threaded installations for mine roof support applications, or other structural support applications, without performing additional process that create the threaded portion of the rebar. For example, standard rebar is designed to hold and reinforce concrete. This type of rebar typically has longitudinal ribs on opposing sides of the bar that prevent rotation after grout (i.e. concrete, resin, etc.) sets. The longitudinal ribs make it unsuitable to double as a tensioning bolt as described in the Fox patents. In addition, rebar has cross-hatching ribs or other rolled-on patterns to prevent rotation and for stabilization after the grout sets, as well as having manufacturer identifiers and/or product identifiers, which all may be rolled into the rebar, thus, making the rebar unsuitable for use as a tensioning bolt of the type described herein. These configurations result in support structures that are permanently fixed, thus, preventing the bolt from being rotated and tightened in the future to increase the tension of the bolt. In these systems the entire support system would have to be replaced when a tensioning problem arises with the permanently fixed bolts.

Using other types of threading equipment may not be practical from a cost or design perspective. For example, using high-speed flat-die or cylindrical-die threading equipment, which are comprised of flat-die or cylindrical-die threaders, may not be useful for rolling the thread pattern into common merchant round steel bar to produce a bolt with twenty-four (24) inches of threads because of the high costs associated with this process and extreme forces necessary to perform the roll-threading action. The flat-die or cylindrical-die threading manufacturing process for a 24" thread would require a massive piece of equipment that used very large and expensive dies, which, if even feasible, would be quite costly to replace. Moreover, this process would require numerous machines to produce the necessary bolts in the required production quantities, each of which would be prohibitively expensive.

Specialty bolts have been manufactured using processes described above with the addition of milling steps, such as rolling rebar and machining the necessary threads or removing the longitudinal ribs by swaging, or machining the threads from bar stock, etc. However, in the case of these specialty bolts the additional machining processes add additional costs to the bolt manufacturing.

With respect to assembling, some types of bolts used in structural support applications require additional hardware, such as nuts or couplers, to screw onto the threads for external post-tensioning. The additional hardware requires preparation methods and assembly steps that increase the cost associated with these configurations that are used in mine roof support structures, as well as in other support applications.

Eliminating the need for machining the bolts, using additional hardware, reducing assembly time, and allowing for re-tensioning of bolts decreases the material and labor costs to install and fix mine roof supports and other support structures while improving the bolt's performance.

In one embodiment of the invention, the threaded rebar bolt 10 illustrated in FIG. 1 is manufactured in a continuous hot-rolling process to create a threaded rebar shaft 12 with semi-continuous threads and substantially no longitudinal ribs in the longitudinal areas 30.

With respect to rolling bolt threads, it should be noted that, although threaded rebar can be hot-rolled in small quantities in specialized machinery, such as three or more rolling dies, multiple rolling die sets offset at various orientations from each other, etc. theses types of manufacturing processes are unrealistic for producing threaded rebar at low costs and high volume. The preferred method of accomplishing quality and quantity hot-rolling is through a steel mini-mill or a micro-mill process. Hot-rolling is typically utilized to create, rebar, merchant rounds, octagon bar, hex bar, structural steel and other shapes in mini-mills, however, the products, in the past, have been and can be, produced using blast furnaces. Mini-mill technology, incorporating the melting of scrap metal, has generally made production of many of these products impractical and cost-prohibitive in major basic iron-ore steel mills.

Basic mini-mill technology includes melting and alloying of scrap metals to meet metallurgical specifications for a given product. This molten steel is then poured into ingots (a batch process) or formed into billets (a continuous process, now almost always employed) that are later reheated and rolled through a progression of reducing mill and finishing mill roll-stands. The end product can then be coiled into a continuous strand or cut into standard lengths as requested by the purchaser.

FIGS. 2 through 5 illustrate various embodiments of the threaded rebar shafts 12 produced using a hot-rolled process. The threaded rebar may be made into various grades and sizes, depending on the specifications for the end support structure application. The resultant threaded bar that is used for the spiral bolts has no longitudinal ribs or flats along the length of the shaft 12 that would hinder rotation within a hardened grout material, such as but not limited to a resin nut. In some embodiments, as illustrated in FIGS. 2 and 3, the shaft 12 of the threaded rebar bolt 10 has a substantially circular core 40 and a substantially oval outer thread 42. The core 40 may have a diameter of approximately 0.680 inches, and the outer thread 42 diameter at the largest area may be approximately 0.750 inches, making the largest thread height approximately 0.035 inches. Furthermore, the threads may have a width of approximately 0.125 inches at the external surface of the threads and a width of approximately 0.150 at the base of the threads. In some embodiments the threads may be the same height around most, or all, of the core 40 of the shaft 12 that the threads cover, however, in some embodiments the thread height will taper as the threads reach the longitudinal area 30 that is void of longitudinal ribs.

The longitudinal area 30 where there are no longitudinal ribs may be approximately 0.110 wide. The first thread set 16 and second thread set 18 may each cover approximately 163.2 degrees of the core 40 of the shaft 12, meaning the areas of the core 40 that are not covered by a thread in between the first thread set 16 and second thread set 18 may only span approximately 16.8 degrees of the core 40. In some embodiments, of the invention the threads within both the first thread set 16 and the second thread set 18 are aligned such that there is an approximately 0.250 inch gap between the threads within each thread set. Furthermore, the first thread set 16 is aligned with the second thread set 18, such that the first thread set 16 and the second thread set 18 forms a semi-continuous thread that may be used to cut channels in grout that is hardening around the threads of the shaft 12, as further described within the Fox patents.

The pitch of the threads may be most efficient and effective at approximately two and one-half (2½) threads per inch on a three-quarters (¾) of an inch round-bar as compared to a typical three-quarters (¾) of an inch standard bolt with 10 threads per inch. Therefore, the threads per-inch to outer thread diameter ratio is approximately 3.333. In other embodiments of the invention the ratio may be approximately 2.5 to 4. In other embodiments of the invention, the thread pitch angle may be approximately twenty four and one-half (24½) degrees.

FIGS. 4 and 5 illustrate a different embodiment of the present invention. As illustrated in FIGS. 4 and 5, the shaft 12 may have a core 40 diameter of approximately 0.750 and an outer thread 42 diameter of approximately 0.875. Thus, the threads are minimal in height, such as for example around approximately one-sixteenth (1/16) of an inch above the core 40 or base of the thread. The first thread set 16 and second thread set 18 may each cover approximately 130 degrees of the core 40 of the shaft 12, meaning the longitudinal areas 30 of the core 40 that are not covered by a thread in the space between the first thread set 16 and second thread set 18 may cover approximately 50 degrees of the core 40, as illustrated in FIG. 5. In other embodiments of the invention the thread coverage of the core may be higher or lower than as provided in examples herein.

In other embodiments of the invention the thread shaft core 40 diameter and outer thread 42 diameter may be five-eighths (⅝) of an inch, three-fourths (¾) of an inch, seven-eighths (⅞) of an inch, one (1) inch and one and one-eighth (1⅛) inch, respectively, or other diameters in other embodiments of the invention.

Once the shaft 12 of the threaded rebar bolt is hot-rolled, the individual required bolt lengths may be cut. Thereafter, tensioning heads 14 may be created on the ends of the shaft 12. For example, an end of each of the individual shafts 12 may be reheated at anytime and a head 14 may be forged on the end of each individual shaft 12. In other embodiments of the invention a head may be formed onto the end the individual shaft 12 by heating the end of the shaft 12 and molding the metal into bolt head. In other embodiments of the invention a head may be created on the end of the shaft 12 by welding a head on the end of the shaft 12, or using any other known means for attaching a head onto the shaft 12 to create a bolt. The process for manufacturing the threaded rebar bolts 10 is a dramatic improvement over existing methods, as discussed herein because no additional machining is required to create the threads after the threaded shaft is created from the hot-rolling process. In addition, this methodology also yields a more-advantageous threaded rebar bolt 10 that is threaded along its entire length, up to the tensioning head 14, which is a feature impracticable using existing fabrication methods. This in turn yields a much-improved threaded rebar bolt 10 for use with a resin nut assembly in mineshafts (as illustrated in the Fox patents), tunnels and/or other support structures.

In one embodiment, the threaded rebar bolt 10 made from the hot-rolling process is designed primarily for use with the tensionable bolt system described in the Fox patents. The threaded rebar bolt 10 is adapted to allow for re-tensioning with relatively equal load distribution onto each thread along the length of the threaded rebar bolt 10 that is incased in the resin material. The threaded rebar bolt 10 used with a resin material provides better load distribution over the threads than would be possible with a standard nut or other coupling apparatus that applies the load to a small amount of threads within the nut, for example, possibly one (1) inch or less of threaded connection length in some cases where a steel or iron nut is used. The specially designed threaded rebar bolt 10 cannot function with longitudinal ribs that are substantially the same height as the threads or non-threaded patterns, as is seen in typical processed rebar. Therefore, in one embodiment of the invention the height of the longitudinal ribs is below the height of the threads. Furthermore, the threaded rebar may form the most advantageous threads in the resin material when there are no longitudinal ribs (or the ribs are recessed below the core surface 44) along the threads that are incased in the resin because the longitudinal ribs will not reduce the depth of the resin thread when the threaded rebar is turned to form the threads in the resin nut (see the Fox patents). Additionally, the typical processed rebar may not function with longitudinal machined flats edges in place of the ribs, because the grout may form around the flat edges preventing the bolt from turning in the grout when the grout hardens. Furthermore, the flat edges reduce the area covered by the threads, and thus, reduce the load capacity that can be supported by the threads.

The process of hot-rolling provides a unique thread pattern for the purpose of direct-tensioning. The resultant threaded rebar has no longitudinal ribs or longitudinal flats along the core that could hinder rotation of the threaded rebar bolt 10 as the resin nut is forming or after it has solidified. The thread pattern is adapted for the practical applications in which it is used, rather than for manufacturer or grade identification. The resultant threaded rebar bolt 10 produced is rotatable in a resin nut as the resin sets to form the channels for turning the threaded rebar bolt 10, and requires no steel or iron nuts or couplers to tension the bolt. The threaded rebar of the present invention may have a formed head for tensioning, can provide the advantage of full-length, or variable length threads, and can allow for tensioning of the bar after the resin has solidified.

Thread pitch, height and circumferential angle of thread coverage may vary within a range that allows for rotation of the bolt bar in a resin nut and for attainment of an acceptable tension to torque ration as defined by the applicable regulatory agency (e.g. MSHA, etc.).

Furthermore, the specified hot-rolled, threaded bar can be produced in mass quantities, and thus provide an adequate supply of threaded rebar bolts 10 to meet high demand at low manufacturing costs. Finally, the threaded rebar may be produced in a wide variety of steel grades and sizes to meet the requirements for the support structure bolts in different applications.

Specific embodiments of the invention are described herein. Many modifications and other embodiments of the invention set forth herein will come to mind to one skilled in the art to which the invention pertains, having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. A threaded rebar product, comprising:

a threaded rebar shaft formed from a hot-rolling process, comprising:

a cylindrical core, semi-continuous threads comprising a first thread section and a second thread section, and longitudinal areas between the first thread section and the second thread section that have longitudinal area heights that are substantially the same height as a core surface of the cylindrical core;

wherein the cylindrical core is formed directly from the hot-rolling process without longitudinal ribs or longitudinal flat edges on the cylindrical core at the longitudinal areas;

wherein the longitudinal areas are formed directly from the hot-rolling process without having to remove longitudinal threads from the longitudinal areas that lack the first thread section and the second thread section; and wherein the threaded rebar shaft is capable of having a head operatively coupled to an end of the threaded rebar shaft to form a fastener.

2. The threaded rebar product of claim 1, wherein the threaded rebar shaft is rotatable in grout formed around the cylindrical core and semi-continuous threads since the threaded rebar shaft lacks the longitudinal ribs or the longitudinal flat edges on the cylindrical core at the longitudinal areas that would inhibit rotation of the threaded rebar shaft within the grout.

3. The threaded rebar product of claim 1, wherein the longitudinal area height is even with the core surface of the cylindrical core.

4. The threaded rebar product of claim 1, wherein the first thread section and the second thread section each span at least 130 degrees of the circumference of the threaded rebar shaft.

5. The threaded rebar product of claim 1, wherein the height of the semi-continuous threads tapers to the core surface of the cylindrical core of the threaded rebar shaft at the longitudinal areas between the first thread section and the second thread section.

6. The threaded rebar product of claim 1, wherein the threaded rebar shaft is formed with the longitudinal area extending substantially the entire length of the threaded rebar shaft.

7. The threaded rebar product of claim 1, further comprising semi-continuous threads that extend along substantially the entire length of the threaded rebar shaft.

8. The threaded rebar product of claim 1, wherein the threaded rebar shaft has a threads per inch to outer thread diameter ratio in the range of approximately 2.5 to 4.

9. The threaded rebar product of claim 1, wherein the semi-continuous threads and longitudinal areas allow for enhanced mixing through rotational turbulence of resin and catalyst to form a resin nut.

10. The threaded rebar product of claim 1, further comprising a shaft core diameter for a three-fourths inch bolt of approximately 0.680 inches.

11. The threaded rebar product of claim 1, further comprising an external thread diameter for a three-fourths inch bolt of approximately 0.750 inches.

12. The threaded rebar product of claim 1, further comprising a thread width of approximately 0.062 to 0.125 inches.

13. A threaded rebar product, comprising:

a threaded rebar shaft formed from a hot-rolling process, comprising:

a cylindrical core, a first thread section and a second thread section, and longitudinal areas between the first thread section and the second thread section that have longitudinal area heights that are substantially the same height as a core surface of the cylindrical core;

wherein the cylindrical core is formed directly from the hot-rolling process without longitudinal ribs or longitudinal flat edges on the cylindrical core at the longitudinal areas; and wherein the longitudinal areas are formed directly from the hot-rolling process without having to remove longitudinal threads from the longitudinal areas that lack the first thread section and the second thread section.

14. The threaded rebar product of claim 13, wherein the first threaded section and second threaded section are formed to comprise a semi-continuous thread.

15. The threaded rebar product of claim 13, wherein the threaded rebar shaft is rotatable in grout formed around the cylindrical core, first thread section, and second thread section since the threaded rebar shaft lacks the longitudinal ribs or the longitudinal flat edges on the cylindrical core at the longitudinal areas that would inhibit rotation of the threaded rebar shaft within the grout.

16. The threaded rebar product of claim 13, wherein the first thread section, the second thread section, and the longitudinal areas allow for enhanced mixing through rotational turbulence of resin and catalyst to form a resin nut.

17. A threaded rebar product, comprising:

a threaded rebar shaft formed from a hot-rolling process, comprising:

a substantially cylindrical core, a first thread section and a second thread section, and longitudinal areas between the first thread section and the second thread section that have longitudinal area heights that are the same height as a core surface of the cylindrical core;

wherein the cylindrical core is formed directly from the hot-rolling process without longitudinal ribs or longitudinal flat edges on the cylindrical core at the longitudinal areas; and wherein the longitudinal areas are formed directly from the hot-rolling process without having to remove longitudinal threads from the longitudinal areas that lack the first thread section and the second thread section.

18. The threaded rebar product of claim 17, wherein the first threaded section and second threaded section are formed to comprise a semi-continuous thread.

19. The threaded rebar product of claim 17, wherein the threaded rebar shaft is rotatable in grout formed around the cylindrical core, first thread section, and second thread section since the threaded rebar shaft lacks the longitudinal ribs or the longitudinal flat sections on the cylindrical core at the longitudinal areas that would inhibit rotation of the threaded rebar shaft within grout.

20. The threaded rebar product of claim 17, wherein the first thread section, the second thread section, and the longitudinal areas allow for enhanced mixing through rotational turbulence of resin and catalyst to form a resin nut.

* * * * *